United States Patent [19]

Dean et al.

[11] Patent Number: 4,706,756

[45] Date of Patent: Nov. 17, 1987

[54] SUBSEA TOOL LAUNCHING EQUIPMENT

[75] Inventors: Alan J. Dean, Skene; Ian J. Hardy, Banchory, both of Scotland

[73] Assignee: British Petroleum Company p.l.c., London, England

[21] Appl. No.: 848,128

[22] Filed: Apr. 4, 1986

[30] Foreign Application Priority Data

Apr. 11, 1985 [GB] United Kingdom ..... 8509287

[51] Int. Cl.[4] ..... E21B 23/08; E21B 33/076

[52] U.S. Cl. ..... 166/344; 166/70; 166/351

[58] Field of Search ..... 166/70, 342, 344, 347, 166/349, 350, 367, 368, 369, 338, 339, 351, 359

[56] References Cited

U.S. PATENT DOCUMENTS

| | | | |
|---|---|---|---|
| 3,536,344 | 9/1969 | Nelson | 166/340 X |
| 4,111,261 | 9/1978 | Oliver | 166/70 X |
| 4,230,186 | 10/1980 | Lewis, Jr. | 166/342 |
| 4,260,022 | 4/1981 | Van Bilderbeek | 166/70 X |
| 4,489,780 | 12/1984 | Duhon | 166/70 |
| 4,513,823 | 4/1985 | Hynes et al. | 166/97 X |
| 4,616,706 | 10/1986 | Huffaker et al. | 166/70 X |

FOREIGN PATENT DOCUMENTS 1322524 7/1973 United Kingdom .

*Primary Examiner*—Stephen J. Novosad
*Assistant Examiner*—David J. Bagnell
*Attorney, Agent, or Firm*—Morgan & Finnegan

[57] ABSTRACT

A subsea pumpdown tool launcher is provided which permits pumpdown operations without requiring riser access from the surface. The launcher includes an entry valve connected to an upper connection of a fluid circulation line which is, in turn, connectable to a pump. An unrestricted riser section is connected to the lower connection of the circulation line. The bottom of this riser section attaches to the top of a second valve for the exit or entry of a pumpdown tool to or from a subsea wellhead. The bottom of the second valve is connected to the top of a lower connection of the fluid circulation line. The bottom of the lower connection is connected to the top of a subsea wellhead assembly.

6 Claims, 3 Drawing Figures

SUBSEA TOOL LAUNCHING EQUIPMENT

BACKGROUND OF THE INVENTION AND FIELD OF THE INVENTION

This invention relates to equipment for launching tools for servicing subsea oil wells.

During the drilling, testing and operation of an oil well it is sometimes necessary to insert and withdraw instruments such as well logging instruments, to deploy tools, e.g. "fishing" tools, and to replace equipment such as down-hole safety valves, pressure plugs, etc.

These operations are often carried out by the technique known as wirelining in which specially designed equipment is lowered down the well suspended from a solid or braided wire.

An alternative technique is that known as "pumpdown" in which, as the name implies, the tool or instrument is pumped through a line to the location where it is required, and returned after use. In theory, pumpdown offers advantages over wirelining, particularly for subsea completions. However, pumpdown has not been widely adopted, mainly because of the added complexity of the completion, the cost and complexity of the additional flowlines and the diverter systems required for multiwell template designs.

Wirelining and pumpdown are reasonably straightforward operations in onshore work where access to the well is readily available through a conventional "Christmas tree" well head at the earth surface.

Offshore production may be carried out from fixed platforms resting on the sea bed or from semi-submersible or floating platforms or vessels which are capable of some degree of movement.

Fixed platforms generally have several individual well risers rising from the sea bed to well head completion equipment on the platform and are analogous to on-shore locations in that access to the wells for wirelining or pumpdown operations is readily available.

In respect of semi-submersible and floating platforms and vessels, however, wells are generally completed on the sea bed and manifolded to a production riser system, or, in the case of satellite wells, may be remote from the production facility and tied back with flowlines and risers. Thus, immediate access to these wells from the surface is not normally available.

Access can be made available by fitting a tensioned riser back to the surface, but this is difficult, time consuming and expensive and may involve considerable loss of production. One method by which this can be achieved when the well is in close proximity to a movable production platform or vessel is to move the latter so that it is positioned with its moon pool or similar facility positioned directly above the well scheduled for wirelining. Another, which is more suitable for satellite wells, involves the temporary use of a drilling or workover vessel.

Both methods involve the use of a tensioned riser supported from the surface on which conventional surface equipment is mounted.

SUMMARY OF THE INVENTION

We have devised a subsea system which enables access to be gained to subsea wells for pumpdown operations without requiring riser access from the surface. This system is hereinafter termed a subsea pumpdown tool launcher.

Thus according to the present invention there is provided a subsea pumpdown tool launcher which comprises (a) means for entry, (b) an upper connection for a circulation line connectable to a pump, (c) a riser section, (d) means for exit, (e) a lower connection for a circulation line connectable to a pump and (f) a connector, preferably a hydraulic connector, adapted for connection to a subsea well head assembly.

Adapter spools may be required in places because of differences in diameter between adjacent components of the tool launcher. However, if adjacent components have the same diameter, then an adapter spool is not necessary.

The connection to the well head assembly is preferably made by way of a re-entry hub.

Suitable means for entry and exit are hydraulically operated full bore valves, such as ball valves or, more preferably, gate valves.

Preferably the valves can be remotely opened and closed to allow entry and removal of equipment into the launcher.

Preferably a cross-over spool is fitted beneath the means for exit and the latter is rotatable so that access to either bore of a dual completion well is obtainable by correct orientation.

The tool launcher may be in one or two sections. In the latter case, a further connector, preferably hydraulic, is interposed between the riser section and the means for exit so that the launcher section may be disconnected from the connector package if desired.

A lifting bar is preferably provided for ease of handling and is most preferably located between the means for entry and the upper connection for a circulating line.

The riser may be strengthened by making it of composite structure with an inner tool carrying tube and an outer casing.

The riser should be of sufficient length to accommodate the longest tool string which is likely to be inserted. In current practice this is approximately 12.5 m.

In use the subsea pumpdown tool launcher will be a free standing structure connected to a subsea wellhead assembly with the entry means uppermost.

Control of all launcher and wellhead functions will normally be hydraulic via an umbilical. A further circulation line may be provided to flush the launcher free from hydrocarbons before opening the means for entry and removing the equipment.

The complete pumpdown tool launcher may be positioned by running on a winch line down guide wires attached to the posts of a standard API tree frame.

It is considerably smaller and lighter than conventional tensioned riser systems and its assembly and deployment is much quicker.

Advantages, when compared with wirelining, include the following: the wireline to the surface is eliminated and therefore the need for heave compensation is also eliminated, greater forces can be generated than those for running or pulling of wireline type tools, since no wireline is used, the risk of breaking wire and having to "fish" for it is removed, and both subsea and surface equipment is simplified.

The novel subsea pumpdown tool launcher can be operated from a specially equipped Dive Support Vessel (DSV).

BRIEF DESCRIPTION OF THE DRAWINGS

The invention is illustrated with reference to FIGS. 1 to 3 of the accompanying drawings wherein.

DESCRIPTION OF PREFERRED EMBODIMENTS

Figure 1:
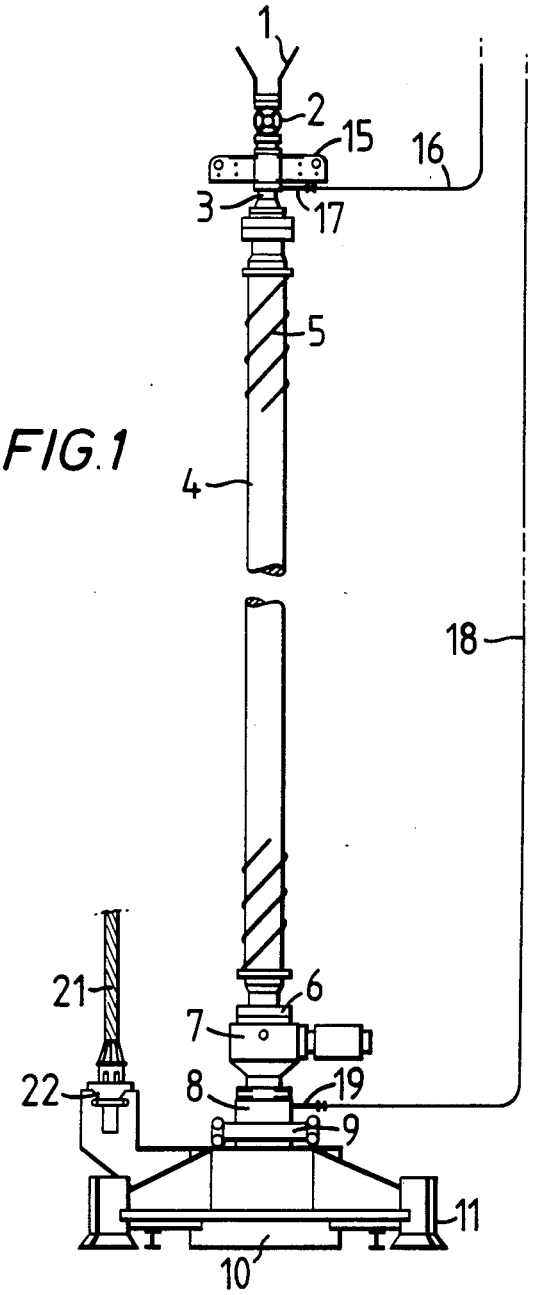
FIG. 1 is an elevation of a single section pumpdown launching tool.
Figure 2:
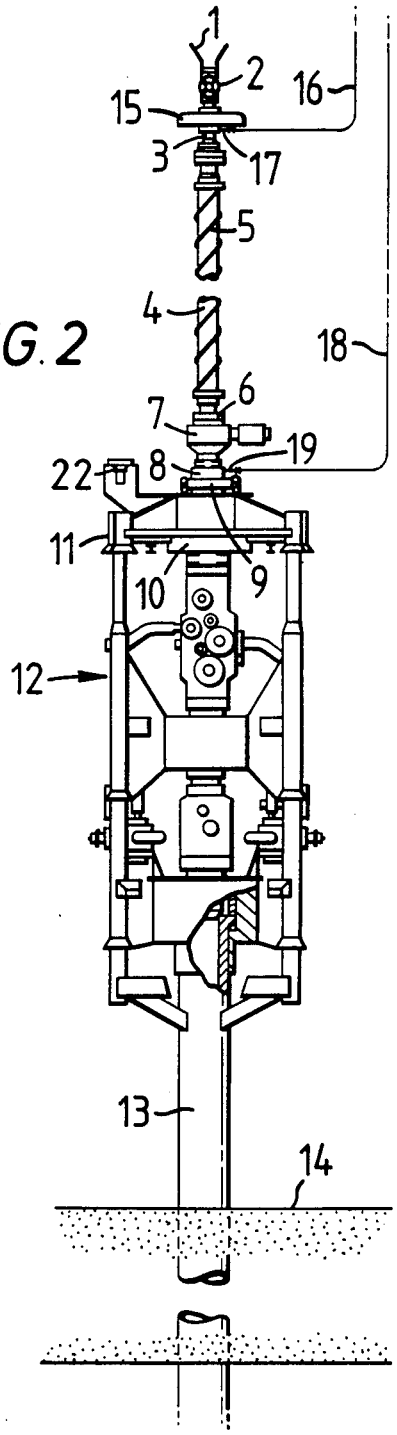
FIG. 2 shows the tool installed on a subsea well head.

With reference to FIGS. 1 and 2, the pumpdown launching tool comprises a cone 1 leading to an entrance gate valve 2 connected by way of an adapter spool 3 to a riser 4 which is, in effect, the storage receptacle for a tool entering or leaving the well. The riser 4 is surrounded by helical strakes 5. These act as vortex shedders when the tool is deployed in waters in which strong currents flow and therefore reduce vibration of the tool.

The base of the riser 4 is connected by way of adapter flanges 6 to an exit foot valve 7 which is rotatable, a cross-over spool 8 and a clamp connector 9 which is connected to a hydraulic connector 10 held in a guide frame 11 at the top of a well head Christmas tree 12 mounted on a conductor 13 leading to a reservoir below the sea bed 14.

The tool is located by means of posts of the tree passing through the guide frame and manipulated by means of a lifting bar 15.

A circulation line 16 leads from a pump on the surface and enters the tool through a connection 17 situated above the riser 4. A circulation line 18 emerges from the tool through a connection 19 situated below the riser 4 and returns to the pump.

Figure 3:
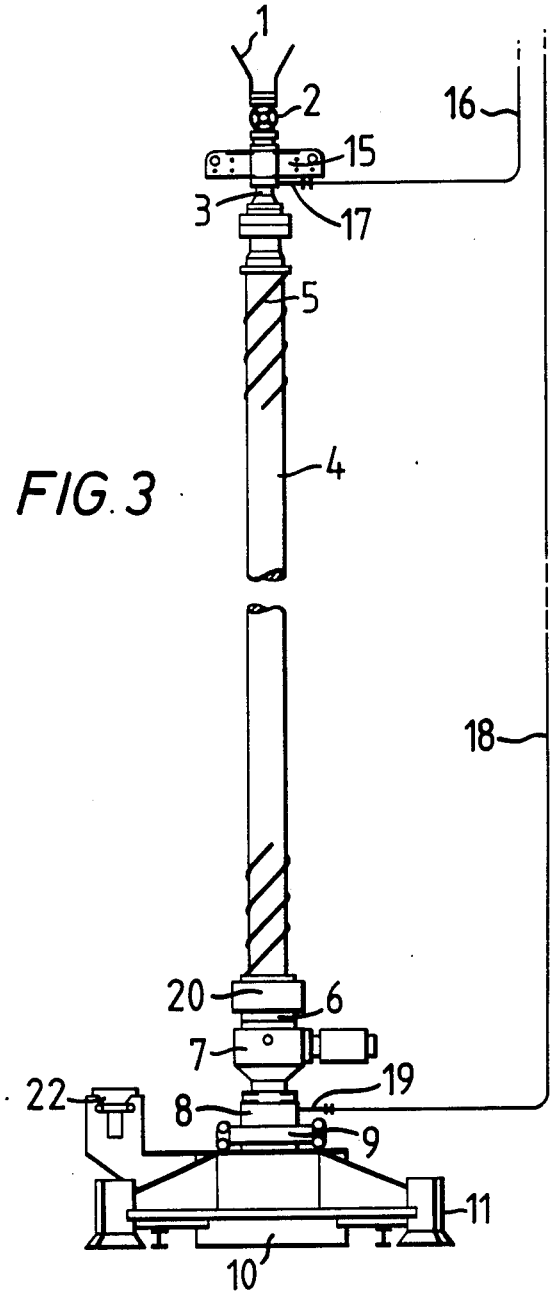
FIG. 3 is an elevation of a modified tool divided into a launcher section and a connector package.

The tool illustrated in FIG. 3 is similar but with the difference that an additional hydraulic connector 20 is interposed between the base of the riser 4 and the adapter flange 6. This enables the launcher section, i.e. Items 1 to 5 and 15 to be disconnected from the connector package, i.e. Items 6 to 10.

Control of the launcher and Christmas tree which is being accessed is via an hydraulic umbilical 21 which connects to the Christmas tree via a conventional pod and receptacle arrangement 22 and to the launcher via a breakaway connection mounted on the guide frame (not shown). In severe weather conditions the control umbilical may be retrieved leaving the launcher and wellhead in a safe condition.

The riser comprises an inner, pressure containing tube through which pumpdown access is gained, and an outer structural casing.

Hydraulic and circulation lines for the control functions above the riser section are run in the annulus between the inner tube and outer casing of the riser.

We claim:

1. A subsea pumpdown tool launcher comprising, in sequence: a first valve for the entry and exit of a pumpdown tool from and to a subsea location, the bottom of said first valve being connected to the top of an upper connection for a pumpdown fluid circulation line, said connection being connectable to a pump, the bottom of the upper connection being connected to the top of an unrestricted riser section adapted to receive a pumpdown tool, the bottom of the unrestricted riser section being connected to the top of a second valve for the exit and entry of a pumpdown tool to and and from a subsea wellhead, the bottom of said second valve being connected to the top of a lower connection for the pumpdown fluid circulation line, said connection being connectable to a pump, the bottom of the lower connection being connected to the top of a subsea wellhead connection.

2. A subsea pumpdown tool launcher according to claim 1 wherein the first and second valves for entry and exit are hydraulically operated full bore valves.

3. A subsea pumpdown tool launcher according to claim 2 wherein the full bore valves are gate valves.

4. A subsea pumpdown tool launcher according to claim 1 wherein a cross-over spool is fitted beneath the second value and the valve is rotatable so that access to either bore of a dual completion well is obtainable.

5. A subsea pumpdown tool launcher according to claim 1 comprising a further connector interposed between the riser section and the second valve.

6. A subsea pumpdown tool launcher according to claim 1 wherein the riser is a composite structure comprising an inner tool carrying tube and an outer casing.

* * * * *